US009966005B2

(12) United States Patent
Wu

(10) Patent No.: US 9,966,005 B2
(45) Date of Patent: May 8, 2018

(54) PIXEL COMPENSATION CIRCUIT, METHOD AND FLAT DISPLAY DEVICE

(71) Applicant: Shenzhen China Star Optoelectronics Technology Co., Ltd., Shenzhen, Guangdong (CN)

(72) Inventor: Xiaoling Wu, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 187 days.

(21) Appl. No.: 15/023,381

(22) PCT Filed: Feb. 25, 2016

(86) PCT No.: PCT/CN2016/074552
§ 371 (c)(1),
(2) Date: Mar. 19, 2016

(87) PCT Pub. No.: WO2017/128467
PCT Pub. Date: Aug. 3, 2017

(65) Prior Publication Data

US 2017/0372663 A1 Dec. 28, 2017

(30) Foreign Application Priority Data

Jan. 29, 2016 (CN) ..... 2016 1 0069689

(51) Int. Cl.
*G09G 3/3233* (2016.01)

(52) U.S. Cl.
CPC ... *G09G 3/3233* (2013.01); *G09G 2300/0439* (2013.01); *G09G 2320/045* (2013.01)

(58) Field of Classification Search
CPC ..... G09G 3/30–3/3291
See application file for complete search history.

(56) References Cited

U.S. PATENT DOCUMENTS 8,018,414 B2 * 9/2011 Huang ..... G09G 3/3233 345/82
8,531,358 B2 * 9/2013 Choi ..... G09G 3/3233 345/76

(Continued)

FOREIGN PATENT DOCUMENTS

CN 101976545 A 2/2011
CN 105096831 A 11/2015

(Continued)

*Primary Examiner* — Patrick F Marinelli
(74) *Attorney, Agent, or Firm* — Andrew C. Cheng

(57) ABSTRACT

Pixel compensation circuit, method and flat display device. The circuit includes control terminals of first to fourth controllable and driving switches respectively connected with first to fourth scanning lines and second terminal of the second controllable switch, first terminal of the first controllable switch connected with data line; first terminal of the second controllable switch connected with second terminal of the first controllable switch; first terminal of the third controllable switch connected with the second terminal of the first controllable switch; the second terminal of the first controllable switch is connected with the second terminal of the driving switch through a storage capacitor; anode of an OLED connected with the second terminal of the driving switch, cathode is grounded; first terminal of the fourth controllable switch connected with second voltage terminal, which can avoid unstable current of the organic light emitting diode by drift of threshold voltage of driving transistor.

5 Claims, 4 Drawing Sheets

(56) References Cited

U.S. PATENT DOCUMENTS 8,654,041 B2 * 2/2014 Kang ..... G09G 3/3233 345/76
8,659,513 B2 * 2/2014 Choi ..... G09G 3/3233 345/212
9,171,503 B2 * 10/2015 Kim ..... G09G 3/3233
9,378,673 B2 * 6/2016 Oh ..... H05B 37/02
9,666,132 B2 * 5/2017 Wu ..... G09G 3/3258
9,779,663 B2 * 10/2017 Kim ..... G09G 3/3258
2006/0187154 A1 8/2006 Tsuchida
2007/0035487 A1 * 2/2007 Ryu ..... G09G 3/3233 345/76
2007/0262939 A1 * 11/2007 Huang ..... G09G 3/3233 345/92
2010/0164847 A1 * 7/2010 Lee ..... G09G 3/3233 345/77
2011/0157143 A1 * 6/2011 Choi ..... G09G 3/3233 345/212
2012/0120042 A1 * 5/2012 Tsai ..... G09G 3/3233 345/211
2013/0009942 A1 * 1/2013 Lee ..... G09G 3/3233 345/212
2014/0084792 A1 * 3/2014 Oh ..... H05B 37/02 315/120
2014/0125713 A1 * 5/2014 Ryu ..... G09G 3/3233 345/690
2014/0184481 A1 * 7/2014 Kim ..... G09G 3/3233 345/82
2015/0084843 A1 3/2015 Li et al.
2015/0115799 A1 * 4/2015 Oh ..... H05B 37/02 315/120
2016/0012778 A1 * 1/2016 Kim ..... G09G 3/3233 345/79
2016/0133187 A1 5/2016 Li et al.
2016/0307501 A1 10/2016 Han
2016/0351123 A1 12/2016 Qing et al.
2016/0365032 A1 * 12/2016 Wu ..... G09G 3/3258
2017/0278457 A1 * 9/2017 Zhu ..... G09G 3/3233

FOREIGN PATENT DOCUMENTS

CN 105206222 A 12/2015
CN 105469745 A 4/2016

* cited by examiner

PIXEL COMPENSATION CIRCUIT, METHOD AND FLAT DISPLAY DEVICE

BACKGROUND OF THE INVENTION

1. Field of the Invention

The present invention relates to a display technology field, and more particularly to a pixel compensation circuit, a method and a flat display device.

2. Description of Related Art

A current Organic Light Emitting diode (OLED) display has advantages of small size, simple structure, self-lighting, high brightness, wide viewing-angle, short response time, and so on, attracting widespread attention.

In the current organic light emitting diode display, a transistor is used as a driving transistor for controlling a current flowing through an organic light emitting diode OLED so that the importance of a threshold voltage of the driving transistor is very obvious. A positive drift or a negative drift of the threshold voltage will make different currents flowing through the organic light emitting diode under a same data signal. In a usage process of the transistor, factors of lighting in the oxide semiconductor or voltage stress of source and drain electrode may cause the threshold voltage to drift such that the current of the organic light emitting diode is unstable, and the display brightness of a panel is uneven.

SUMMARY OF THE INVENTION

The main technology problem solved by the present invention is to provide a pixel compensation circuit, a method and a flat display device in order to avoid an unstable current of the organic light emitting diode caused by the drift of the threshold voltage of the driving transistor to realize an even brightness display of the pane In order to solve the above technology problem, a technology solution provided by the present invention is: a pixel compensation circuit, comprising:

a first controllable switch, wherein the first controllable switch includes a control terminal, a first terminal and a second terminal; the control terminal of the first controllable switch is connected with a first scanning line, a first terminal of the first controllable switch is connected with a data line in order to receive a data voltage from the data line;

a second controllable switch, wherein the second controllable switch includes a control terminal, a first terminal and a second terminal; the control terminal of the second controllable switch is connected with a second scanning line the first terminal of the second controllable switch is connected with the second terminal of the first controllable switch;

a driving switch, wherein the driving switch includes a control terminal, a first terminal and a second terminal; the control terminal of the driving switch is connected with the second terminal of the second controllable switch, the first terminal of the driving switch is connected with a first voltage terminal in order to receive a first voltage from the first voltage terminal;

a third controllable switch, wherein the third controllable switch includes a control terminal, a first terminal and a second terminal; the control terminal of the third controllable switch is connected with a third scanning line; the first terminal of the third controllable switch is connected with the second terminal of the first controllable switch and the first terminal of the second controllable switch, the second terminal of the third controllable switch is connected with the first terminal of the driving switch;

a storage capacitor, wherein the storage capacitor includes a first terminal and a second terminal; the first terminal of the storage capacitor is connected with the second terminal of the first controllable switch, and the second terminal of the storage capacitor is connected with the second terminal of the driving switch;

an organic light emitting diode, wherein the organic light emitting diode includes an anode and a cathode; the anode of the organic light emitting diode is connected with the second terminal of the driving switch, and the cathode of the organic light emitting diode is connected with a ground; and a fourth controllable switch, wherein the fourth controllable switch includes a control terminal, a first terminal and a second terminal; the control terminal of the fourth controllable switch is connected with a fourth scanning line, the first terminal of the fourth controllable switch is connected with a second voltage terminal in order to receive a second voltage from the second voltage terminal, and the second terminal of the fourth controllable switch is connected with the second terminal of the driving switch.

Wherein, the driving switch, the first controllable switch to the fourth controllable switch are all NMOS thin-film transistors, PMOS thin-film transistors or a combination of NMOS thin-film transistors and PMOS thin-film transistors; the control terminal, the first terminal and the second terminal of each of the driving switch, the first controllable switch to the fourth controllable switch are respectively corresponding to a gate electrode, a drain electrode and a source electrode of the thin-film transistor.

In order to solve above technology problem, another technology solution provided by the present invention is: a pixel compensation method, comprising:

in a reset stage, a driving switch and a fourth controllable switch are turned on, a first to a third controllable switches are turned off, a voltage Vb at a second terminal of the driving switch is equal to a second voltage VL outputted from a second voltage terminal; because of a coupling function of a storage capacitor, a voltage Va at a first terminal of the storage capacitor is decreased so as to remove an affection of a data of a previous frame;

in a threshold voltage obtaining stage, the driving switch, the second controllable switch and the third controllable switch are both turned on, the first controllable switch and the fourth controllable switch are both turned off, the storage capacitor is charged; the voltage Vb at the second terminal of the driving switch is equal to a difference value between a first voltage VDD outputted from a first voltage terminal and a threshold voltage Vth of the driving switch, the voltage Va of the first terminal of the storage capacitor is equal to the first voltage VDD;

in a data writing stage, the driving switch and the first controllable switch are both turned on, the second to the fourth switches are turned off, and the storage capacitor is charged; the voltage Va at the first terminal of the storage capacitor is equal to a data voltage Vdata outputted from a data line; the voltage Vb at the second terminal of the driving switch, $Vb=VDD-Vth+\Delta V$, wherein, VDD is the first voltage, Vth is the threshold voltage of the driving switch, ΔV is a voltage increment at the second terminal of the driving switch; and in a driving emitting stage, the driving switch and the second controllable switch are both turned on, the first controllable switch, the third controllable switch and the fourth controllable switch are all turned off; the storage capacitor is discharged, a voltage difference Vgs between the control terminal and the second terminal of the driving switch is equal to a voltage difference between two terminals of the storage capacitor, that is, Vgs=Vdata−VDD+Vth−ΔV, a current I flowing through the organic light emitting diode is that I=K*(Vgs−Vth)2=K*(Vdata−VDD−ΔV)2, wherein K is a coefficient.

Wherein, the driving switch, the first controllable switch to the fourth controllable switch are all NMOS thin-film transistors, PMOS thin-film transistors or a combination of NMOS thin-film transistors and PMOS thin-film transistors; the control terminal, the first terminal and the second terminal of each of the driving switch, the first controllable switch to the fourth controllable switch are respectively corresponding to a gate electrode, a drain electrode and a source electrode of the thin-film transistor.

In order to solve above technology problem, another technology solution provided by the present invention is: a flat display device, wherein, the flat display device includes a pixel compensation circuit, and the pixel compensation circuit comprises:

a first controllable switch, wherein the first controllable switch includes a control terminal, a first terminal and a second terminal; the control terminal of the first controllable switch is connected with a first scanning line, a first terminal of the first controllable switch is connected with a data line in order to receive a data voltage from the data line;

a second controllable switch, wherein the second controllable switch includes a control terminal, a first terminal and a second terminal; the control terminal of the second controllable switch is connected with a second scanning line the first terminal of the second controllable switch is connected with the second terminal of the first controllable switch;

a driving switch, wherein the driving switch includes a control terminal, a first terminal and a second terminal; the control terminal of the driving switch is connected with the second terminal of the second controllable switch, the first terminal of the driving switch is connected with a first voltage terminal in order to receive a first voltage from the first voltage terminal;

a third controllable switch, wherein the third controllable switch includes a control terminal, a first terminal and a second terminal; the control terminal of the third controllable switch is connected with a third scanning line; the first terminal of the third controllable switch is connected with the second terminal of the first controllable switch and the first terminal of the second controllable switch, the second terminal of the third controllable switch is connected with the first terminal of the driving switch;

a storage capacitor, wherein the storage capacitor includes a first terminal and a second terminal; the first terminal of the storage capacitor is connected with the second terminal of the first controllable switch, and the second terminal of the storage capacitor is connected with the second terminal of the driving switch;

an organic light emitting diode, wherein the organic light emitting diode includes an anode and a cathode; the anode of the organic light emitting diode is connected with the second terminal of the driving switch, and the cathode of the organic light emitting diode is connected with a ground; and a fourth controllable switch, wherein the fourth controllable switch includes a control terminal, a first terminal and a second terminal; the control terminal of the fourth controllable switch is connected with a fourth scanning line, the first terminal of the fourth controllable switch is connected with a second voltage terminal in order to receive a second voltage from the second voltage terminal, and the second terminal of the fourth controllable switch is connected with the second terminal of the driving switch.

Wherein, the driving switch, the first controllable switch to the fourth controllable switch are all NMOS thin-film transistors, PMOS thin-film transistors or a combination of NMOS thin-film transistors and PMOS thin-film transistors; the control terminal, the first terminal and the second terminal of each of the driving switch, the first controllable switch to the fourth controllable switch are respectively corresponding to a gate electrode, a drain electrode and a source electrode of the thin-film transistor.

Wherein the flat display device is an OLED or an LCD.

The beneficial effects of the present invention are: comparing with the prior art, the pixel compensation circuit and method of the present invention, through using multiple thin-film transistors as a driving transistor in order to avoid an unstable current of the organic light emitting diode caused by the drift of the threshold voltage of the driving transistor to realize an even brightness display of the panel.

DETAILED DESCRIPTION OF THE PREFERRED EMBODIMENT

Figure 1:
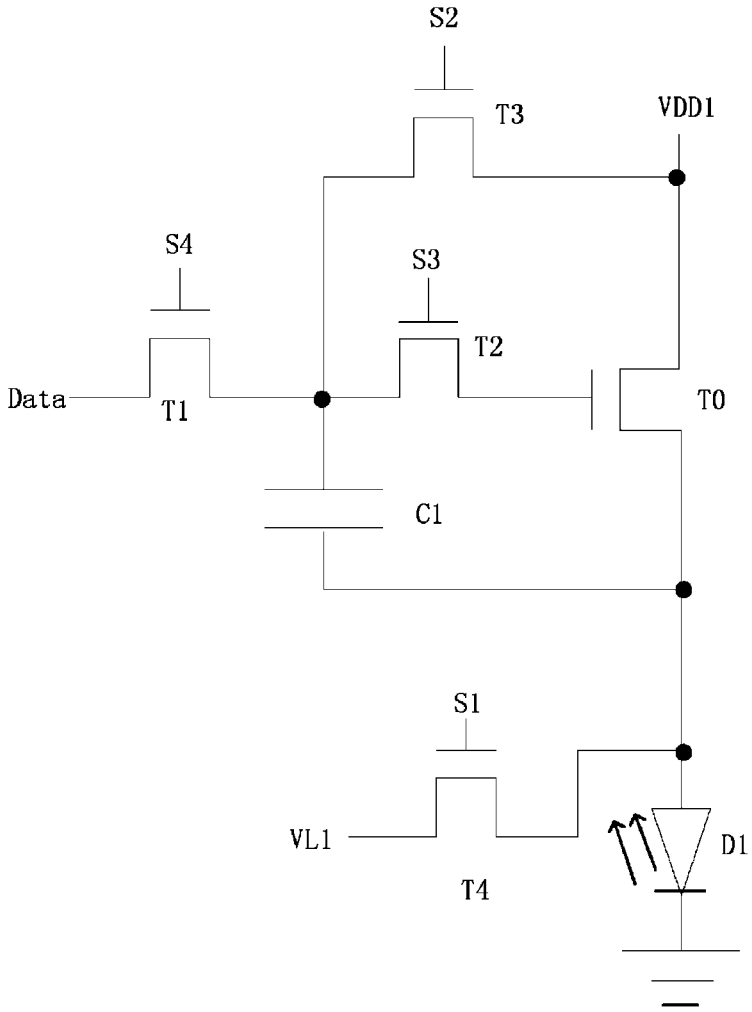
FIG. 1 is a schematic diagram of a pixel compensation circuit of the present invention.

With reference to FIG. 1, and FIG. 1 is a schematic diagram of a pixel compensation circuit of the present invention. As shown in FIG. 1, the pixel compensation circuit includes a first controllable switch T1. The first controllable switch T1 includes a control terminal, a first terminal and a second terminal. The control terminal of the first controllable switch T1 is connected with a first scanning line S4, a first terminal of the first controllable switch T1 is connected with a data line Data in order to receive a data voltage Vdata from the data line Data.

A second controllable switch T2, the second controllable switch T2 includes a control terminal, a first terminal and a second terminal. The control terminal of the second controllable switch T2 is connected with a second scanning line S3, the first terminal of the second controllable switch T2 is connected with the second terminal of the first controllable switch T1;

A driving switch T0, the driving switch T0 includes a control terminal, a first terminal and a second terminal. The control terminal of the driving switch T0 is connected with the second terminal of the second controllable switch T2, the first terminal of the driving switch T0 is connected with a first voltage terminal VDD1 in order to receive a first voltage VDD from the first voltage terminal VDD1.

A third controllable switch T3, the third controllable switch T3 includes a control terminal, a first terminal and a second terminal. The control terminal of the third controllable switch T3 is connected with a third scanning line S2. The first terminal of the third controllable switch T3 is connected with the second terminal of the first controllable switch T1 and the first terminal of the second controllable switch T2. The second terminal of the third controllable switch T3 is connected with the first terminal of the driving switch T0.

A storage capacitor C1, the storage capacitor C1 includes a first terminal and a second terminal. The first terminal of the storage capacitor C1 is connected with the second terminal of the first controllable switch T1, and the second terminal of the storage capacitor C1 is connected with the second terminal of the driving switch T0;

An organic light emitting diode D1, the organic light emitting diode D1 includes an anode and a cathode. The anode of the organic light emitting diode D1 is connected with the second terminal of the driving switch T0, and the cathode of the organic light emitting diode D1 is connected with a ground.

A fourth controllable switch T4, the fourth controllable switch T4 includes a control terminal, a first terminal and a second terminal. The control terminal of the fourth controllable switch T4 is connected with a fourth scanning line S1, the first terminal of the fourth controllable switch T4 is connected with a second voltage terminal VL1 in order to receive a second voltage VL from the second voltage terminal VL1, and the second terminal of the fourth controllable switch T4 is connected with the second terminal of the driving switch T0.

In the present embodiment, the driving switch T0, the first controllable switch T1 to the fourth controllable switch T4 are all NMOS thin-film transistors, PMOS thin-film transistors or a combination of NMOS thin-film transistors and PMOS thin-film transistors. The control terminal, the first terminal and the second terminal of each of the driving switch T0, the first controllable switch T1 to the fourth controllable switch T4 are respectively corresponding to a gate electrode, a drain electrode and a source electrode of the thin-film transistor.

Figure 2:
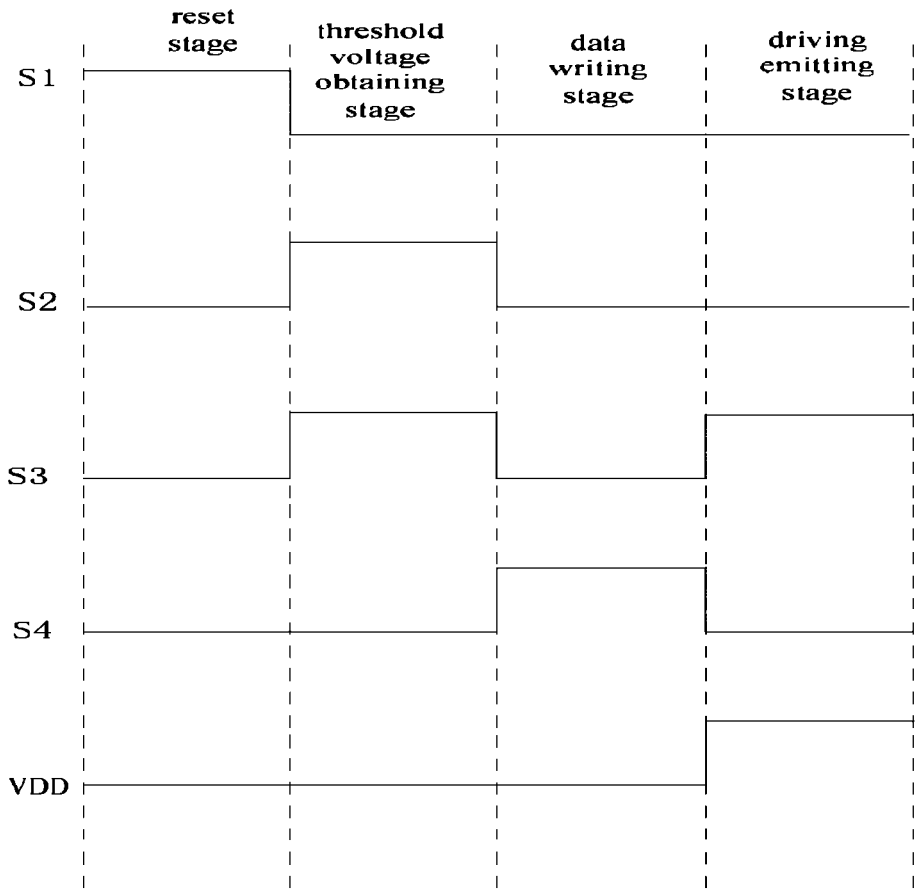
FIG. 2 is a waveform diagram of the pixel compensation circuit of the present invention.
Figure 3:
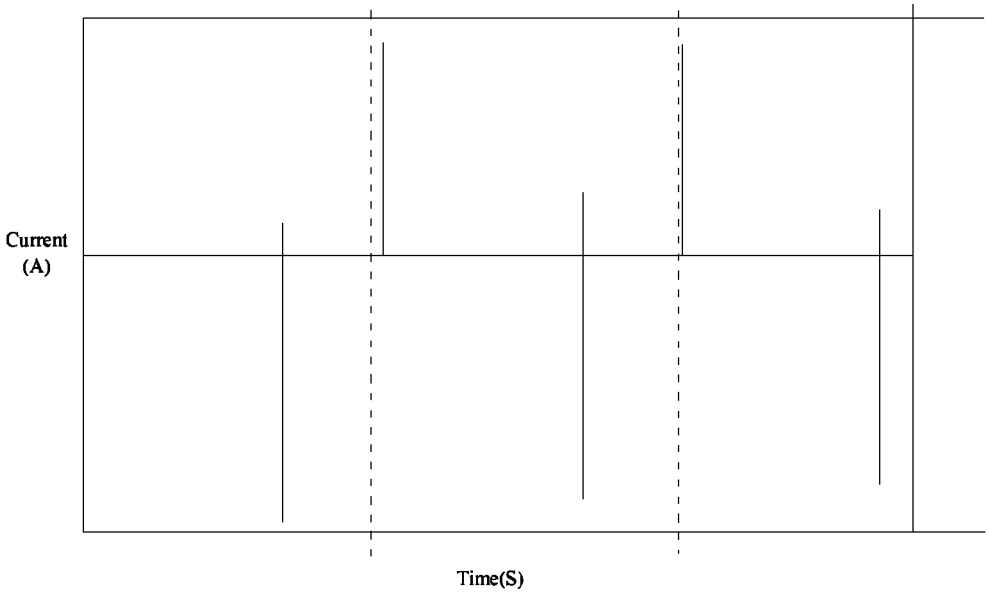
FIG. 3 is a simulation result diagram of the pixel compensation circuit of the present invention.

With reference to FIG. 2, and FIG. 2 is a waveform diagram of the pixel compensation circuit of the present invention. FIG. 3 is a simulation result diagram of the pixel compensation circuit of the present invention. According to FIG. 1 to FIG. 3, the operation principle (the pixel compensation method) of the pixel compensation circuit obtained from FIG. 1 to FIG. 3 is as following:

In a reset stage, a driving switch T0 and a fourth controllable switch T4 are turned on, a first to a third controllable switches T1-T3 are turned off. A voltage Vb at a second terminal of the driving switch T0 is equal to a second voltage VL outputted from a second voltage terminal VL1. Because of a coupling function of a storage capacitor C1, a voltage Va at a first terminal of the storage capacitor C1 is decreased so as to remove an affection of a data of a previous frame;

In a threshold voltage obtaining stage, the driving switch T0, the second controllable switch T2 and the third controllable switch T3 are both turned on. The first controllable switch T1 and the fourth controllable switch T4 are both turned off. The storage capacitor C1 is charged. The voltage Vb at the second terminal of the driving switch T0 is equal to a difference value between a first voltage VDD outputted from a first voltage terminal VDD1 and a threshold voltage Vth of the driving switch T0. The voltage Va of the first terminal of the storage capacitor C1 is equal to the first voltage VDD.

In a data writing stage, the driving switch T0 and the first controllable switch T1 are both turned on, the second to the fourth switches T2-T4 are turned off, and the storage capacitor C1 is charged. The voltage Va at the first terminal of the storage capacitor C1 is equal to a data voltage Vdata outputted from a data line Data. The voltage Vb at the second terminal of the driving switch T0 satisfies a following relationship:

$$Vb=VDD-Vth+\Delta V \quad \text{(formula 1)}$$

wherein, VDD is the first voltage, Vth is the threshold voltage of the driving switch T0, ΔV is a voltage increment at the second terminal of the driving switch T0. The voltage increment is generated because a variation of the voltage Va (the variation value is Vdata−VDD) at the first terminal of the storage capacitor C1, through a coupling action of capacitors (including the storage capacitor C1, a capacitor of the light emitting diode D1, parasitic capacitors of the second controllable switch T2 and the driving switch T0) so that the voltage Vb at the second terminal of the driving switch T0 is also varied (the variation value is ΔV).

In a driving emitting stage, the driving switch T0 and the second controllable switch T2 are both turned on, the first controllable switch T1, the third controllable switch T3 and the fourth controllable switch T4 are all turned off. The storage capacitor C1 is discharged, a voltage difference Vgs between the control terminal and the second terminal of the driving switch T0 is equal to a voltage difference between two terminals of the storage capacitor C1, and that is, Vgs satisfy a following relationship:

$$Vgs=V\text{data}-VDD+Vth-\Delta V \quad \text{(formula 2);}$$

a current I flowing through the organic light emitting diode D1 satisfy a flowing relationship:

$$I=K*(Vgs-Vth)^2=K*(V\text{data}-VDD-\Delta V)^2 \quad \text{(formula 3);}$$

wherein, K is a coefficient and satisfies a following relationship:

$$K=\mu\text{Cox}W/(2*L) \quad \text{(formula 4);}$$

Wherein, μ is electron mobility, Cox is a capacitance of an insulation layer of a thin-film transistor of a unit area; L and W are respectively an effective channel and channel width length of the driving switch T0.

From the above formula 3 and formula 4 and combined with table 1 shown below, a current flowing through the organic light emitting diode D1 is unrelated to the threshold voltage Vth of the driving switch T0.

TABLE 1

| Vdata | Vto = 1.2 V $I_{OLED}$ | Vto = 1.7 V $I_{OLED}$ | % $\Delta I_{OLED}$ | Vto = 0.7 V $I_{OLED}$ | % $\Delta I_{OLED}$ |
|---|---|---|---|---|---|
| V1 | 5.78E−08 | 5.58E−08 | 3.42% | 5.58E−08 | 3.45% |
| V2 | 5.51E−07 | 5.53E−07 | 0.25% | 5.70E−07 | 3.30% |
| V3 | 1.10E−06 | 1.08E−06 | 1.51% | 1.11E−06 | 1.20% |

Therefore, the pixel compensation circuit can avoid an unstable current of the light emitting diode caused by the drift of the threshold voltage Vth of the driving switch T0 in order to realize an even brightness display of the panel.

Figure 4:
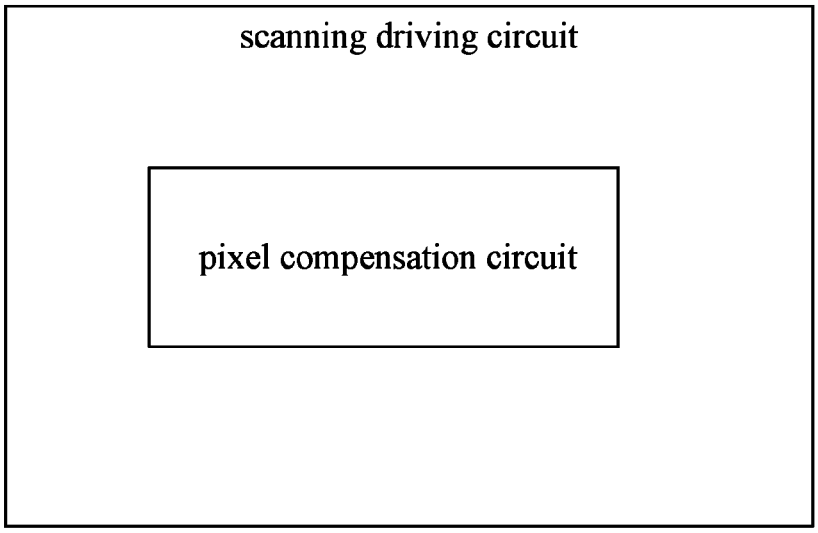
FIG. 4 is a schematic diagram of a scanning driving circuit of the present invention.

With reference to FIG. 4, and FIG. 4 is a schematic diagram of scanning driving circuit of the present invention. The scanning driving circuit includes a pixel compensation circuit to avoid an uneven brightness display of the panel generated by the drifting of the threshold voltage of the driving transistor in the scanning driving circuit.

Figure 5:
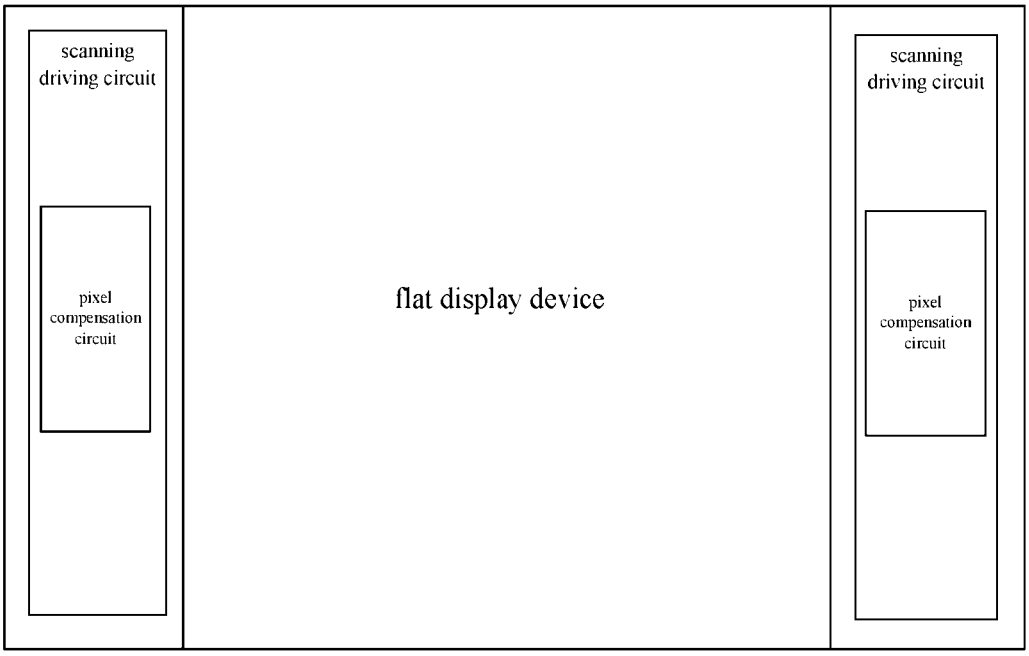
FIG. 5 is a schematic diagram of a flat display device of the present invention.

FIG. 5 is a schematic diagram of a flat display device of the present invention. The flat display device can be an OLED or an LCD. The flat display device includes the above scanning driving circuit and the pixel compensation circuit. The scanning driving circuit of the pixel compensation circuit is disposed at the periphery of the flat display device such as disposing at two terminals of the flat display device.

The pixel compensation circuit and method, through using multiple thin-film transistors as a driving transistor in order to avoid an unstable current of the organic light emitting diode caused by the drift of the threshold voltage of the driving transistor to realize an even brightness display of the panel.

The above embodiments of the present invention are not used to limit the claims of this invention. Any use of the content in the specification or in the drawings of the present invention which produces equivalent structures or equivalent processes, or directly or indirectly used in other related technical fields is still covered by the claims in the present invention.

What is claimed is:

1. A pixel compensation circuit, comprising:

a first controllable switch, wherein the first controllable switch includes a control terminal, a first terminal and a second terminal; the control terminal of the first controllable switch is connected with a first scanning line, a first terminal of the first controllable switch is connected with a data line in order to receive a data voltage from the data line;

a second controllable switch, wherein the second controllable switch includes a control terminal, a first terminal and a second terminal; the control terminal of the second controllable switch is connected with a second scanning line the first terminal of the second controllable switch is connected with the second terminal of the first controllable switch;

a driving switch, wherein the driving switch includes a control terminal, a first terminal and a second terminal; the control terminal of the driving switch is connected with the second terminal of the second controllable switch, the first terminal of the driving switch is connected with a first voltage terminal in order to receive a first voltage from the first voltage terminal, and the driving switch has a threshold voltage;

a third controllable switch, wherein the third controllable switch includes a control terminal, a first terminal and a second terminal; the control terminal of the third controllable switch is connected with a third scanning line; the first terminal of the third controllable switch is directly connected with the second terminal of the first controllable switch and the first terminal of the second controllable switch, the second terminal of the third controllable switch is connected with the first terminal of the driving switch and the first voltage terminal in order to receive the first voltage from the first voltage terminal;

a storage capacitor, wherein the storage capacitor includes a first terminal and a second terminal; the first terminal of the storage capacitor is connected with the second terminal of the first controllable switch and the first terminal of the second controllable switch, and the second terminal of the storage capacitor is connected with the second terminal of the driving switch, wherein the first terminal of the third controllable switch is also directly connected with the first terminal of the storage capacitor, and when the third controllable switch is turned on, the first terminal of the storage capacitor is charged by the first voltage from the first voltage terminal;

an organic light emitting diode, wherein the organic light emitting diode includes an anode and a cathode; the anode of the organic light emitting diode is connected with the second terminal of the driving switch, and the cathode of the organic light emitting diode is connected with a ground; and a fourth controllable switch, wherein the fourth controllable switch includes a control terminal, a first terminal and a second terminal; the control terminal of the fourth controllable switch is connected with a fourth scanning line, the first terminal of the fourth controllable switch is connected with a second voltage terminal in order to receive a second voltage from the second voltage terminal, and the second terminal of the fourth controllable switch is connected with the second terminal of the driving switch.

2. The pixel compensation circuit according to claim 1, wherein, the driving switch, the first controllable switch to the fourth controllable switch are all NMOS thin-film transistors, PMOS thin-film transistors or a combination of NMOS thin-film transistors and PMOS thin-film transistors; the control terminal, the first terminal and the second terminal of each of the driving switch, the first controllable switch to the fourth controllable switch are respectively corresponding to a gate electrode, a drain electrode and a source electrode of the thin-film transistor; wherein when the second controllable switch is also turned on, a voltage at the second terminal of the storage capacitor is equal to a difference value between the first voltage outputted from the first voltage terminal and the threshold voltage of the driving switch.

3. A flat display device, wherein, the flat display device includes a pixel compensation circuit, and the pixel compensation circuit comprises:

a first controllable switch, wherein the first controllable switch includes a control terminal, a first terminal and a second terminal; the control terminal of the first controllable switch is connected with a first scanning line, a first terminal of the first controllable switch is connected with a data line in order to receive a data voltage from the data line;

a second controllable switch, wherein the second controllable switch includes a control terminal, a first terminal and a second terminal; the control terminal of the second controllable switch is connected with a second scanning line the first terminal of the second controllable switch is connected with the second terminal of the first controllable switch;

a driving switch, wherein the driving switch includes a control terminal, a first terminal and a second terminal; the control terminal of the driving switch is connected with the second terminal of the second controllable switch, the first terminal of the driving switch is connected with a first voltage terminal in order to receive a first voltage from the first voltage terminal, and the driving switch has a threshold voltage;

a third controllable switch, wherein the third controllable switch includes a control terminal, a first terminal and a second terminal; the control terminal of the third controllable switch is connected with a third scanning line; the first terminal of the third controllable switch is directly connected with the second terminal of the first controllable switch and the first terminal of the second controllable switch, the second terminal of the third controllable switch is connected with the first terminal of the driving switch and the first voltage terminal in order to receive the first voltage from the first voltage terminal;

a storage capacitor, wherein the storage capacitor includes a first terminal and a second terminal; the first terminal of the storage capacitor is connected with the second terminal of the first controllable switch and the first terminal of the second controllable switch, and the second terminal of the storage capacitor is connected with the second terminal of the driving switch, wherein the first terminal of the third controllable switch is also directly connected with the first terminal of the storage capacitor, and when the third controllable switch is turned on, the first terminal of the storage capacitor is charged by the first voltage from the first voltage terminal;

an organic light emitting diode, wherein the organic light emitting diode includes an anode and a cathode; the anode of the organic light emitting diode is connected with the second terminal of the driving switch, and the cathode of the organic light emitting diode is connected with a ground; and a fourth controllable switch, wherein the fourth controllable switch includes a control terminal, a first terminal and a second terminal; the control terminal of the fourth controllable switch is connected with a fourth scanning line, the first terminal of the fourth controllable switch is connected with a second voltage terminal in order to receive a second voltage from the second voltage terminal, and the second terminal of the fourth controllable switch is connected with the second terminal of the driving switch.

4. The flat display device according to claim 3, wherein, the driving switch, the first controllable switch to the fourth controllable switch are all NMOS thin-film transistors, PMOS thin-film transistors or a combination of NMOS thin-film transistors and PMOS thin-film transistors; the control terminal, the first terminal and the second terminal of each of the driving switch, the first controllable switch to the fourth controllable switch are respectively corresponding to a gate electrode, a drain electrode and a source electrode of the thin-film transistor; wherein when the second controllable switch is also turned on, a voltage at the second terminal of the storage capacitor is equal to a difference value between the first voltage outputted from the first voltage terminal and the threshold voltage of the driving switch.

5. The flat display device according to claim 3, wherein the flat display device is an OLED.

* * * * *